United States Patent [19]

Toshimitsu et al.

[11] 4,363,550

[45] Dec. 14, 1982

[54] RECORDING SHEET SEPARATING DEVICE IN A TRANSFER-TYPE ELECTRONIC COPYING MACHINE

[75] Inventors: Kenshi Toshimitsu, Yokohama; Akihiro Kanazashi, Tokyo; Mitsuaki Kohyama, Higashikurume, all of Japan

[73] Assignee: Tokyo Shibaura Denki Kabushiki Kaisha, Kawasaki, Japan

[21] Appl. No.: 213,076

[22] Filed: Dec. 4, 1980

[30] Foreign Application Priority Data

Dec. 6, 1979 [JP] Japan ..... 54-157449

[51] Int. Cl.[3] ..... G03G 15/00

[52] U.S. Cl. ..... 355/3 TR; 355/3 R; 355/3 SH; 355/14 TR; 355/14 SH; 118/651; 430/33; 271/DIG. 2

[58] Field of Search ..... 355/3 TR, 3 R, 14 R, 355/14 TR, 3 SH, 14 SH, 3 DD, 14 D; 118/621, 624, 623, 625, 628, 644, 647, 648, 651, 656, 639; 430/122, 33; 271/DIG. 2

[56] References Cited

U.S. PATENT DOCUMENTS

| | | | |
|---|---|---|---|
| 3,620,617 | 11/1971 | Kelly et al. | 355/3 TR |
| 3,691,993 | 9/1972 | Krause et al. | 355/3 TR |
| 3,877,417 | 4/1975 | Jeromin | 355/3 TR X |
| 3,936,174 | 2/1976 | Carpenter | 355/3 TR |
| 4,055,380 | 10/1977 | Borostyan | 355/3 TR |
| 4,159,172 | 6/1979 | Nishikawa et al. | 355/3 TR |
| 4,223,993 | 9/1980 | Tsuda et al. | 355/3 TR X |

FOREIGN PATENT DOCUMENTS 2459760 12/1977 Fed. Rep. of Germany .

*Primary Examiner*—Arthur C. Prescott

*Attorney, Agent, or Firm*—Cushman, Darby & Cushman

[57] ABSTRACT

In a transfer-type electronic copying machine including a photosensitive drum, charging device, exposure device, developing device, transfer device, and separating device, the separating device of this invention has a separating section for separating a recording sheet bearing a toner image thereon from the surface of the photosensitive drum. The recording sheet is guided by a guide roller facing the photosensitive drum and having a slit formed therein, and is brought in contact with a conductive brush through the slit to be de-electrified.

5 Claims, 6 Drawing Figures

RECORDING SHEET SEPARATING DEVICE IN A TRANSFER-TYPE ELECTRONIC COPYING MACHINE

BACKGROUND OF THE INVENTION

This invention relates to an electronic copying machine, more specifically to an improvement of a recording sheet separating device for de-electrifying a recording sheet separated from a photosensitive member after a toner image formed on a surface of the photosensitive member is transferred to the recording sheet.

Copying machines or other like apparatus generally use a device for separating a recording sheet from a photosensitive member to fix the recording sheet after a toner image on the photosensitive member is transferred to the recording sheet. With use of the separating device, the recording sheet bearing the transferred toner image thereon is separated from a photosensitive drum, and is wound around an insulating turn roller to shift its direction toward a fixing device. However, the recording sheet separated from the photosensitive drum, bearing electric charges, will suffer local discharge caused by a potential difference produced when it touches or approaches a carrier guide or other conductive material. If such local discharge is caused before fixation, toner on the recording sheet will be scattered to disturb the resultant toner image. In order to prevent the local discharge from affecting the recording sheet during the conveyance, therefore, a recording sheet 13 is conventionally de-electrified by means of a conductive brush 11 facing a photosensitive drum 10 before it is separated from the drum 10 by a separating claw 12, and then wound around a turn roller 14, or de-electrified by means of a conductive brush 17 disposed in a sheet passage 16, as shown in FIG. 1. Before the separation, however, the space for the setting of the conductive brush 11 is so narrow that the conductive brush 11 may often have its tip caught by the turn roller 14 to be damaged, or is liable to be contaminated by the scattered toner and will fail to sustain the de-electrifying effect. In the sheet passage 16, on the other hand, the recording sheet will bend as indicated by a broken line to vary the gap between itself and the conductive brush 17, so that it is difficult to adjust the location of the conductive brush 17, resulting in impossibility of stable de-electrification.

As an example of such a separating device, there is a device stated in Japanese Utility Model Disclosure No. 53-46843; Y. Aguro et al., Apr. 20, 1978. This device is so constructed that a conductive needlelike electrode with flexibility is brought into contact with a de-electrifying device from under a recording material at an inclination of 25° to 45° toward the discharge direction of a transfer material. In such a prior art device, however, de-electrification is performed on the fixing roller side without avoiding the aforementioned drawbacks.

In a device stated in Japanese Patent Disclosure No. 52-125331; K. Nakahata et al., Oct. 21, 1977, which is equivalent to the prior art device as shown in FIG. 1 hereof, de-electrification is performed after a recording material is separated from a photosensitive drum without obviating the aforementioned drawbacks.

SUMMARY OF THE INVENTION

The object of this invention is to provide a separating device in a transfer-type electronic copying machine capable of securely removing residual charges on a recording sheet when the recording sheet is separated from a photosensitive member and preventing a toner image from being scattered due to local discharge which the recording sheet may suffer before fixation, thereby producing a clear image.

In order to attain the above object, the separating device of the invention, which may be used in a transfer-type electronic copying machine including a photosensitive member, a charging device, an exposure device, a developing device, a transfer device, and a separating device, comprises separating means for separating a recording sheet bearing a toner image thereon from the surface of the photosensitive member, guide means facing the photosensitive member and having at least one slit, whereby the separated recording sheet is supported, and de-electrifying means for de-electrifying the recording sheet through the slit.

According to this invention, since the recording sheet separated from the photosensitive member can be de-electrified while it is wound around the insulating guide, it may be protected against defective de-electrification due to its bending. Further, the adjustment of the location of the de-electrifying device may be facilitated to enable prevention of scattering of a toner image due to local discharge in a sheet passage without the defective de-electrification, thereby ensuring production of clear copy images. After completion of the copying operation, moreover, the awkwardness in handling the recording sheet attributable to residual charges is eliminated to improve the operating efficiency. If the insulating guide is fixed as in a first modified example, the conductive brush is always in slide contact with the recording sheet, so that the de-electrifying effect may be further improved as compared with the effect obtained with use of a turn roller. Furthermore, if an AC corona charger is used as the de-electrifying device as in a second modified example, fine adjustment of the de-electrifying effect may be achieved with ease by only regulating the voltage.

BRIEF DESCRIPTION OF THE DRAWINGS

Other objects and features of the invention are apparent from the following description taken in connection with the accompanying drawings, in which.

DETAILED DESCRIPTION OF THE PREFERRED EMBODIMENTS

Figure 1:
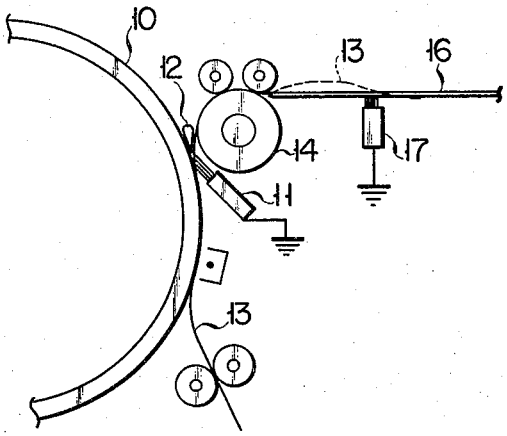
FIG. 1 PRIOR ART
FIG. 1 is a sectional view of a prior art separating device in a transfer-type electronic copying machine.
Figure 3:
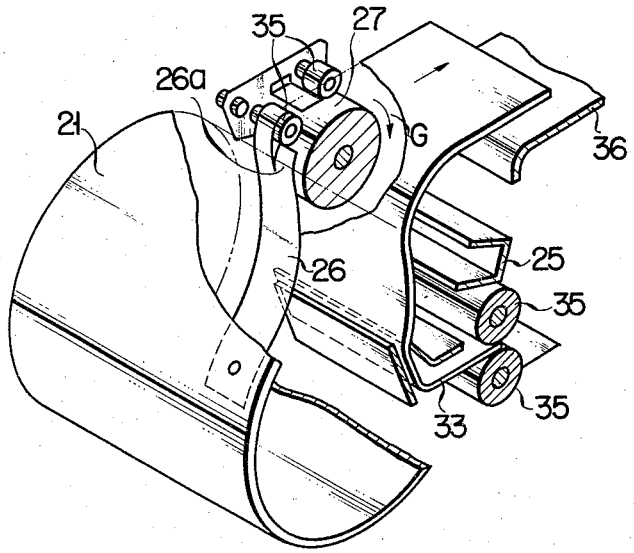
FIG. 3 is an enlarged perspective view of the peripheral portion of the separating device in the transfer-type electronic copying machine shown in FIG. 2.
Figure 2:
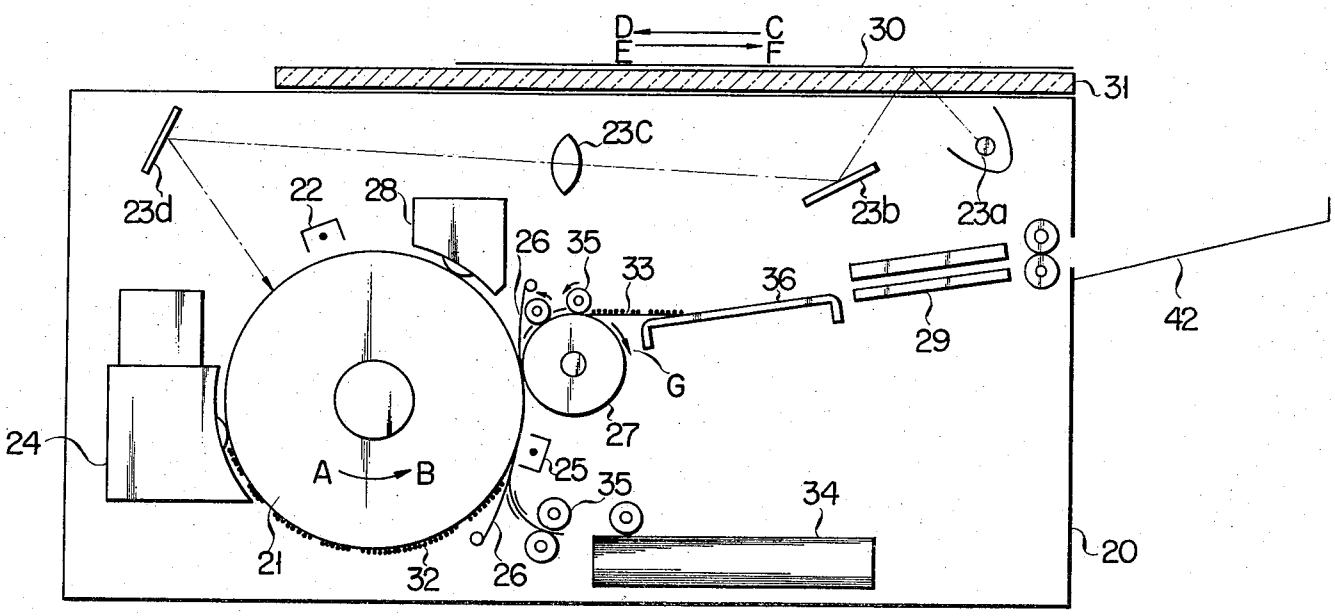
FIG. 2 is a general block diagram of a transfer-type electronic copying machine to which a separating device of this invention is applied.

FIG. 2 is a general block diagram of a transfer-type electronic copying machine to which a separating device of this invention is applied. The transfer-type electronic copying machine 20 is composed of a photosensitive drum 21, charging unit 22, exposure device 23, developing device 24, transfer device 25, separating section 26, guide roller 27, cleaning device 28, and fixing device 29. Linked with a suitable driving means (not shown), the photosensitive drum 21 rotates in the direction of an arrow AB of FIG. 2, that is, in the counterclockwise direction. The charging unit 22 for uniformly charging the whole surface of the photosensitive drum 21 is disposed adjacently to the photosensitive drum 21. The exposure device 23 is located at the upper portion of the main body of the electronic copying machine 20, including an exposure lamp 23*a*, first mirror 23*b*, lens 23*c*, second mirror 23*d*, and original rest 31 capable of reciprocating in the directions of arrows CD and EF and sustaining an original 30. When the exposure lamp 23*a* is turned on, the original rest 31 bearing the original 30 thereon moves in the direction of the arrow EF, and an electrostatic latent image corresponding to an image of the original 30 is formed on the photosensitive drum 21. The developing device 24 applies a developer to the electrostatic latent image, thereby producing a toner image 32. A recording sheet 33 is fed from a sheet supply cassette 34, and transmitted by means of a pair of rollers 35. As shown in FIG. 3, the separating section 26 formed of a thin leaf of mica is pressed and held against an edge portion in a specific region of the peripheral surface of the photosensitive drum 21. A forward end portion 26*a* of the separating section 26 is spaced from the peripheral surface of the photosensitive drum 21, and is in contact with the surface of the guide roller 27. The transfer device 25 is disposed in parallel with the peripheral surface of the photosensitive drum 21 to supply the toner image 32 from the photosensitive drum 21 to the recording sheet 33. The recording sheet 33 is separated from the photosensitive drum 21 by the end portion 26*a* of the separating section 26, and is guided by the guide roller 27 which forms part of the separating device. The guide roller 27 is disposed above the transfer device 25 so as to be able to rotate in the direction of an arrow G, facing the peripheral surface of the photosensitive drum 21 across a space. A pair of small rollers 35 are rotatably disposed on the peripheral surface of the guide roller 27 so as to hold down the recording sheet 33 of the guide roller 27 and to carry it to a guide plate 36 and the fixing device 29. The fixing device 29, which is located behind the guide plate 36, fixes the toner image 32 on the recording sheet 33. A tray 42 is disposed outside the main body 20, and stores the recording sheet 33 which has been discharged. The cleaning device 28, which is disposed between the guide roller 27 and the exposure device 23, removes remaining toner on the photosensitive drum 21. The guide roller 27 is made out of a material which has an electrical resistance within a range from $10^5$ Ωcm to $10^{13}$ Ωcm. Such material may be obtained by mixing carbon powder with silicone rubber or urethane rubber. Theoretically, however, the guide roller 27 according to this invention need not wholly be formed of a material with the aforesaid electrical resistance.

Figure 4:
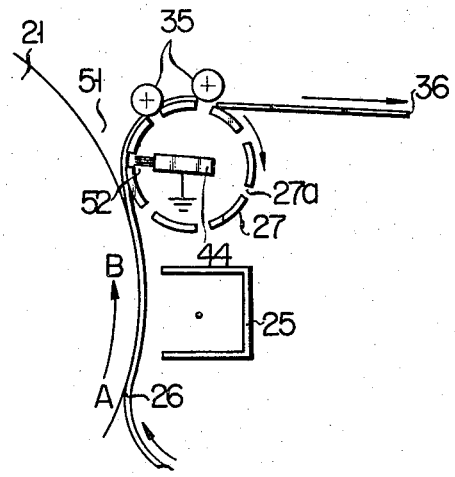
FIG. 4 is a sectional view showing an embodiment of the invention.

FIG. 4 is a sectional view showing an embodiment of the recording sheet separating device of the invention.

The separating device 51 is composed of the separating section 26, guide roller 27, a pair of rollers 35 for holding down the recording sheet 33, and guide plate 36. Slits 27*a* are bored through the guide roller 27 along the longitudinal direction thereof, and a conductive brush 44 formed of an aluminum support with fine metal wires 52 planted therein is disposed in a space inside the guide roller 27. The fine metal wires 52 project out of the guide roller 27 to come in contact with or approach the back of the recording sheet 33.

In the recording sheet separating device of the above-mentioned construction, when copying is started, the toner image is formed on the photosensitive drum 21 successively by the charging device 22, exposure device 23, and developing device 24 as the photosensitive drum 21 rotates in the direction of the arrow AB, and the toner image is transferred to the recording sheet 33 by the transfer device 25. Then, the recording sheet 33 reaches the separating device 51, and its forward edge is separated from the photosensitive drum toward the guide roller 27 by the separating section 26. At the time of such separation, the recording sheet 33 is not de-electrified yet, and is wound around the insulating guide roller 27 while keeping the electric charges to shift its direction toward the fixing device 29. While the recording sheet 33 is being wound around the guide roller 27, the back of the recording sheet 33 is discharged and de-electrified by the fine metal wires of the conductive brush 44 protruding through the slit 27*a* of the guide roller 27. Thereafter, the recording sheet 33 is carried by the guide plate 36, and fixed by the fixing device 29 to complete the copying operation. With such construction, the conductive brush 44 may be brought in contact with the recording sheet 33 being wound around the guide roller 27 through the slit 27*a* of the guide roller 27, so that the distance between the recording sheet 33 and the conductive brush 44 can be maintained constant to ensure stable de-electrifying effect.

Figure 5:
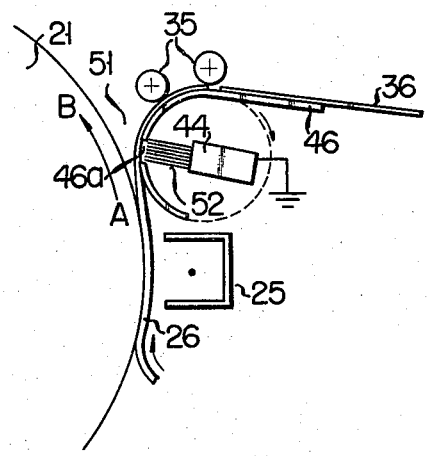
FIG. 5 is a sectional view showing a first modification of the embodiment of FIG. 4.

FIG. 5 shows a first modification of the embodiment of FIG. 4. In this modification, the insulating guide is a plate-like guide 46 with a slit 46*a* which is formed of a material with a small coefficient of friction.

Figure 6:
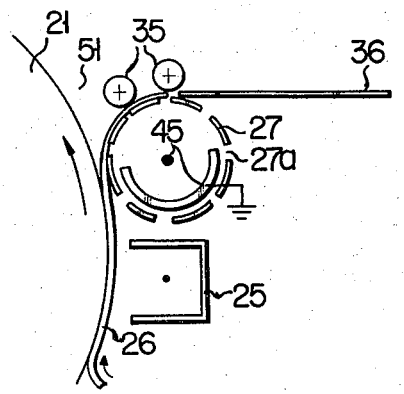
FIG. 6 is a sectional view showing a second modification of the embodiment of FIG. 4.

FIG. 6 shows a second modification of the embodiment of FIG. 4. In this modification, an AC corona charger 45 is used in place of the conductive brush 44 as a de-electrifying device. Also with these constructions, there may be obtained the same effect the embodiment of FIG. 4 provides.

This invention is not limited to the above-mentioned precise embodiments, and various changes and modifications may be effected without departing from the scope or spirit of the invention.

What we claim is:

1. A separating device for use in a transfer-type copying machine for separating a recording sheet from a surface of a photosensitive member after a developed image on the surface of the photosensitive member has been transferred to the recording sheet at an image transfer station, said separating device comprising:
   (a) separating means for separating the recording sheet bearing a toner image thereon from the surface of said photosensitive member;
   (b) guide means, facing said photosensitive member and having at least one opening, for supporting the separated recording sheet; and
   (c) de-electrifying means, separate from said guide means, for de-electrifying said recording sheet through said opening, said guide means maintaining constant the distance between said recording sheet and said de-electrifying means.

2. A separating device according to claim 1, wherein said guide means is a cylindrical turn roller inside which said de-electrifying means is disposed.

3. A separating device according to claim 1, wherein said guide means is a plate having a curved surface.

4. A separating device according to claim 1, wherein said de-electrifying means is a conductive brush inserted in said opening to face said recording sheet.

5. A separating device according to claim 1, wherein said de-electrifying means is an AC corona charger to charge said recording sheet with electricity.

* * * * *